United States Patent [19]

Rosenberg

[11] 4,041,965

[45] Aug. 16, 1977

[54] POOL CLEANING DEVICE

[76] Inventor: Jeffrey P. Rosenberg, 1270 Stillwater Drive, Miami Beach, Fla. 33141

[21] Appl. No.: 622,899

[22] Filed: Oct. 16, 1975

[51] Int. Cl.[2] ..... B08B 3/02; B08B 9/08

[52] U.S. Cl. ..... 134/167 R; 134/180; 239/246; 239/251

[58] Field of Search ..... 134/56 R, 166 R–169 R, 134/176, 179–181; 15/1.7; 239/191–192, 246, 251; 4/172.15, 172.16, 172.17

[56] References Cited

U.S. PATENT DOCUMENTS

| | | | |
|---|---|---|---|
| 1,721,237 | 7/1929 | Todd et al. | 239/246 X |
| 1,938,838 | 12/1933 | Jacobson | 239/251 X |
| 3,287,755 | 11/1966 | Pansini | 15/1.7 |
| 3,598,132 | 8/1971 | Miller | 134/167 R |
| 3,828,931 | 8/1974 | Henricksen | 210/169 X |
| 3,932,281 | 1/1976 | Pansini | 210/169 X |

*Primary Examiner*—Robert L. Bleutge

[57] ABSTRACT

A water driven pool cleaning device to sweep a swimming pool floor which includes a housing and a conduit to connect the housing to a water source. Water flow is directed through the housing and through a rotatable pair of arms, journaled for rotation above the housing, to distally arranged nozzles which are arranged to cause the arms to rotate and to cause debris on the pool floor to be flowed by water toward the housing. The housing defines a trap to collect the debris. The arms are connected to the housing so as to permit travel of a roller on the arms over the high and low areas of a pool floor.

9 Claims, 3 Drawing Figures

POOL CLEANING DEVICE

This is an improvement of my co-pending patent application Ser. No. 601,449, Filed Aug. 4, 1975.

FIELD OF THE INVENTION

This invention relates to a pool cleaning device and, more particularly, to a pool cleaning device which is adapted to rest on the bottom of a pool and to direct a stream of water over the bottom of the pool to urge debris to move toward a trap or, alternatively, to be drained from the pool and removed by exterior filtering means.

BACKGROUND OF THE INVENTION

As referred to in my co-pending application there are numerous devices which have been utilized for cleaning pools. Especially in outside pools, debris settles to the bottom and must be constantly removed for a clean pool, which is a recurring troublesome task for pool owners. This invention is of a device which may be utilized for removing said debris in a gradual process without the need for manual labor. The cleaning is effected by a stream of water which urges debris from the floor of the pool to a collector means.

In the preferred embodiment illustrated, the collector means includes a housing having a deflector arranged in contact with the pool floor which is of cone-shaped form defining a ramp surface which terminates at its upper end at a lip surface of a collector or debris trap. Periodically the trap is removed and emptied; or optionally, the housing may have a floor section which can be removed to form an opening to fit over the main drain of a pool so that the debris is pumped from the pool to an exterior filter.

Figure 1:
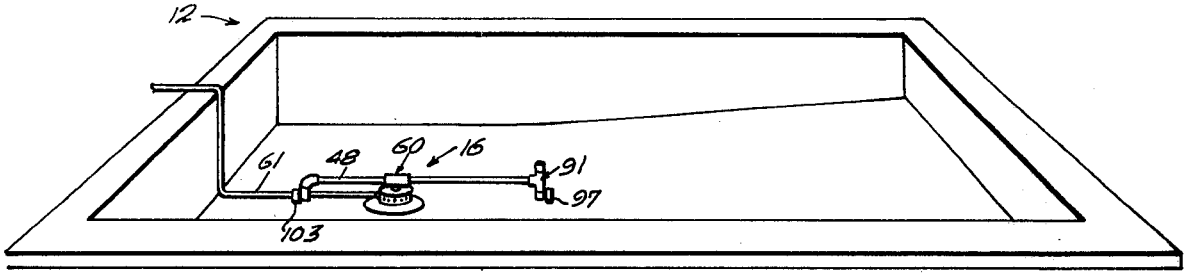
FIG. 1 is a perspective view of a pool in which the instant invention is installed.

DESCRIPTION OF THE PREFERRED EMBODIMENT:

Referring to the drawings wherein like reference characters designate like or corresponding parts throughout the several views, there is shown in FIG. 1 a pool which is generally designated by the numeral 12. Often such a pool includes a drain opening in the floor of the deeper end of the pool. The pool cleaning device is generally designated by the numeral 16 and is shown in more detail in FIG. 2.

Figure 2:
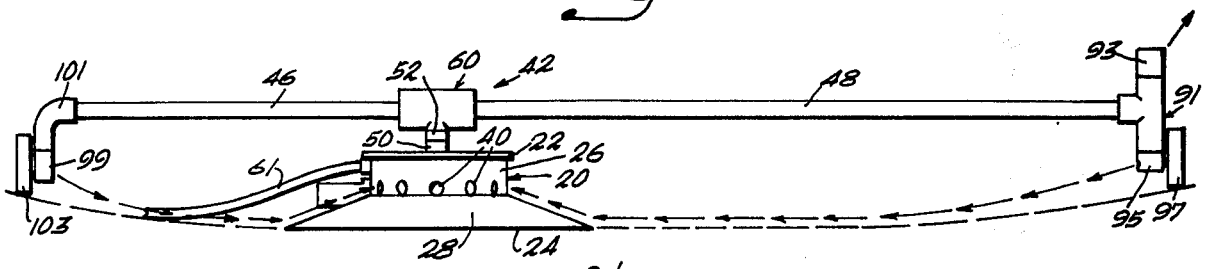
FIG. 2 is a side elevation view of the invention.

Referring to FIG. 2 it is seen that the device includes a housing 20 having an upper end 22 and a lower end 24 which are interconnected by a generally tubular side wall. In the illustrated embodiment, the lower end 24 of the housing is enlarged relative to the upper end and the side wall includes an upper end zone 26 which is generally cylindrical and a lower outwardly diverging generally truncated cone-shaped lower portion 28. The lower end 24 defines a floor for the housing adapted to rest on a pool floor. In the preferred embodiment, the lower end or housing floor includes a central opening 30 which is threaded to receive an annular removable plate 32. As will be apparent hereinafter, when the plate is removed, this opening comprises a main outlet adapted to be positioned over the main drain of a pool. In some pool installations, however, there is no main drain. Also, in large pools it may be necessary or desirable to clean the shallow end of a pool which ordinarily does not have a main drain. In such circumstances, the closure plate is not removed, in which event the cone-shaped portion becomes a collector or trap receptacle for debris swept into it. In the wall of the device, above the lower end or pool floor level, and preferably at the juncture of the circular upper end zone of the wall and the inclined ramp-type or deflector zone of the wall, there are a plurality of inlet openings 40 which open into the receptacle; these openings are arranged at a common height above the end of the housing. Above the housing a laterally extending tubular arm arrangement 42 is provided. Each has an interior laterally extending column 44 to accommodate water flow. In the illustrated preferred embodiment, the tubular arrangement 42 includes a first longer length portion 46 and a second shorter length portion 48, the latter being preferably about one-half the length of the first mentioned portion. Means are provided to connect the arm arrangement to the housing. In a preferred embodiment this comprises a vertical spindle means 49. Generally speaking, the spindle means is conventional and may include a lower member 50 fixed to the housing which carries a rotatable upper member 52 which is interconnected as by the mating flanges 54 and 56. An upwardly and downwardly facing threaded socket means of the spindle parts connect to threaded fittings of the arm arrangement and upper housing end respectively. The fitting of the arm arrangement is included on a connector T member 60. The stem connects to the spindle, while the proximal ends of each of the arms is suitably connected to the ends of the bar of the T member.

In use, water may be flowed from a source through a conduit 61 connected to a threaded inlet nozzle 63 into the housing and, thence, through the interior conduit 65 of the housing, up through the spindle and stem and out the arms to exit through jet openings. One jet opening 69 causes the arms to rotate, since tangential forces are directed to rotate them. The other jet openings 67 and 71 direct water flow over the pool floor toward the housing which carries debris with the flow.

In the preferred embodiment, the structure at the end of the longer arm comprises a T-shaped member 91 with a nozzle fitting 93 in an upwardly facing socket and a downwardly extending nozzle fitting 95 in the downwardly facing opening. To the lower nozzle fitting a wheel 97 is journaled. With respect to the shorter arm, a nozzle fitting 99 is connected to an elbow 101 which extends downwardly, and is also provided with a wheel 103 which is journaled to it. It is thus seen that the members will travel over the pool surface on the wheels.

Figure 3:
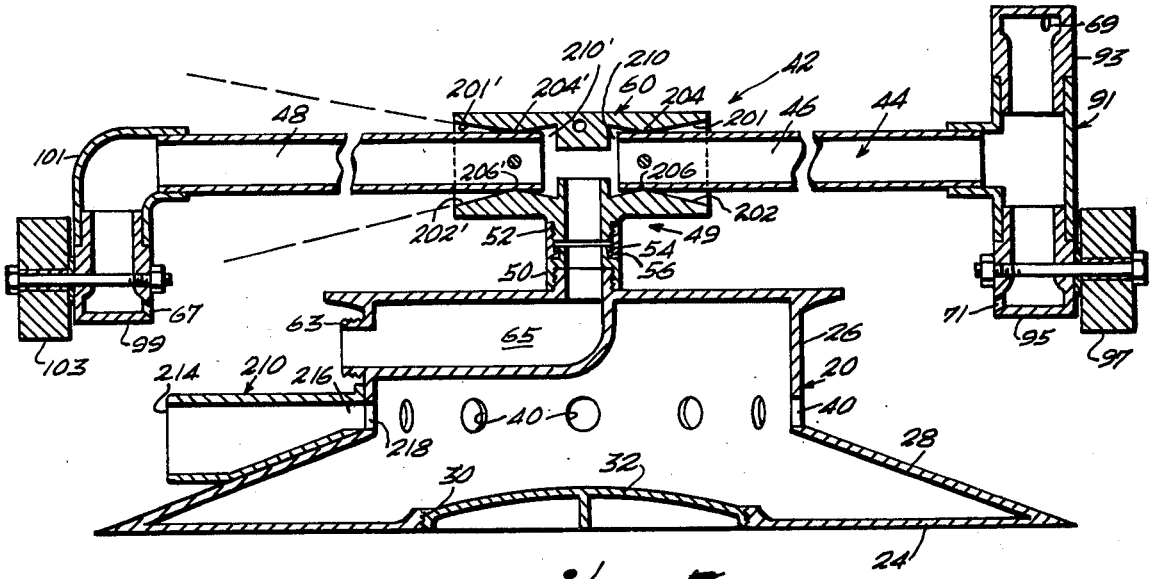
FIG. 3 is a view in cross section of the device shown in FIG. 2.

Referring now to the T-shaped member 60 and, more particularly to its sockets, as seen in FIG. 3, each is characterized by an inwardly diverging roof 201 and floor 202 and 201' and 202' which terminate at a fulcrum zone 204 and 206 and 204' and 206'. The arm is pivotally connected in the socket for swinging vertical movement. In this manner, when the wheel rotates over the high and low areas of the pool surface, the arm will pivot upwardly and downwardly without flexing of the pipe being necessary. Clearance space 210 and 210' is provided for the inner terminal or proximal ends of the arms.

If the trap receptacle is not positioned over a pool drain with the plate 32 removed and weight means on the receptacle to orient it and hold it in position, the plate closes the bottom and debris collects within the housing. It can be physically dumped. Alternatively as shown in FIG. 3, there is an adapter provided to apply suction to withdraw debris periodically. The adapter 212 has a first end and a second end. The first end 214 is adapted to be connected to a suction hose and the second end 216 is adapted to be connected to the housing in conferring relation of one of the mouths 218 through the wall. In this manner, suction may be applied to the first end of the adapter to suck debris collected in the receptacle trap out through the port for periodic cleaning of the trap, so that it does not have to be physically removed from the floor of the pool. The means to connect to the housing, may be adhesive or any suitable means.

What is claimed is:

1. A pool cleaning device comprising:

a debris receptacle trap having an upper end, a lower end and an axially extending side wall, said side wall including a truncated cone-shaped ramp-type deflector surface extending from said lower end upwardly and inwardly toward said upper end and toward a plurality of outwardly facing mouths in the wall to direct a flow of water and debris toward the device into the receptacle trap, a radially extending tubular arm, means rotatably connecting the arm to the housing for rotation with respect to the axis of the housing, means to connect the column of said arm in fluid communication with a source of water, and a water jet assembly supported distally on the tubular arm radially spaced outwardly from the housing and having a radially inwardly facing opening to direct water flow toward the housing, and a generally tangentially facing opening to cause the arm to turn about the axis of the receptacle trap.

2. The device as set forth in claim 1 wherein the side wall defines an upper end zone extending upwardly from said ramp-type deflector surface, said upper end zone being generally cylindrical, said mouths being arranged at the juncture of said upper end zone and said cone-shaped ramp-type deflector surface.

3. The device as set forth in claim 2 wherein means to connect said arm in fluid communication with a source of water comprises an opening in the wall of said upper end zone and conduit means extending through said receptacle trap and upper end and means rotatably connecting the arm to the housing.

4. The device as set forth in claim 2 wherein an adapter means is provided, said adapter means having a first end and a second end, said second end being adapted to cover one of the mouths of said wall and said first end being adapted to connect to a hose length for exteriorly applying suction to the housing and means to connect the adapter to the housing.

5. The device as set forth in claim 1 wherein the lower end comprises a first annular portion and a second portion and thread means interconnecting the second portion to the first annular portion for removal of the lower end portion for removing debris from the receptacle trap.

6. The device as set forth in claim 5 wherein the wall of said housing at said upper end diverges outwardly and upwardly comprising a secondary deflector surface above said ramp-type deflector surface.

7. The device as set forth in claim 5 wherein means to connect said arm in fluid communication with a source of water comprises an opening in the wall of said upper end zone and conduit means extending through said receptacle trap and upper end and means rotatably connecting the arm to the housing.

8. The device as set forth in claim 1 wherein the wall of said housing at said upper end diverges outwardly and upwardly comprising a secondary deflector surface above said ramp-type deflector surface.

9. In a pool cleaning device including (a) a housing having an upper end, a lower end and a generally axially extending side wall, (b) a radially extending tubular arm, (c) means rotatably connecting the arm to the housing for rotation with respect to the housing, and (d) said arm having an interior through column and an opening in fluid communication with a passageway through said means to connect, (e) means on the device for connecting a hose to flow water through said means to connect and said column, and (f) a water jet assembly supported distally on the tubular arm radially spaced outwardly from the housing with a radially inwardly facing opening to direct water flowing through the means to connect and column toward said housing and a tangentially facing opening to cause the arm to rotate with respect to the housing, the improvement which comprises:

said means rotatably connecting the arm to the housing comprising:

a body defining a through passageway having a first branch and a second branch, said first branch having a downwardly facing opening comprising spindle means journaled for rotation to the upper end of said housing and said spindle means having a through opening and said second branch extending outwardly from said first branch to an outwardly diverging mouth zone, said mouth zone being defined by an outwardly diverging roof and outwardly diverging floor and side walls spaced from one another a distance equal to the maximum cross sectional width of the arm, means pivotally connecting the arm for swinging movement and captivating the arm against sidewise movement.

* * * * *